US007902954B2

(12) United States Patent
Bamber et al.

(10) Patent No.: US 7,902,954 B2
(45) Date of Patent: Mar. 8, 2011

(54) DUAL SIDED CONNECTOR BLOCK

(75) Inventors: Daniel W. Bamber, St. Clair Shores, MI (US); Eugene F. Moody, Waterford, MI (US); Anthony J. Mattord, Rochester Hills, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 12/421,593

(22) Filed: Apr. 9, 2009

(65) Prior Publication Data

US 2010/0259348 A1 Oct. 14, 2010

(51) Int. Cl.
*H01F 27/30* (2006.01)
*H01R 25/00* (2006.01)

(52) U.S. Cl. ..... 336/208; 336/198; 439/638

(58) Field of Classification Search ..... 439/654, 439/638

See application file for complete search history.

(56) References Cited

U.S. PATENT DOCUMENTS

| | | | | |
|---|---|---|---|---|
| 2,649,558 | A * | 8/1953 | Franz | 336/192 |
| 4,183,607 | A | 1/1980 | Hughes | |
| 4,251,911 | A * | 2/1981 | Reynolds et al. | 29/605 |
| 4,318,069 | A * | 3/1982 | Morse | 336/192 |
| 4,486,949 | A | 12/1984 | Allen | |
| 5,152,550 | A * | 10/1992 | Hoagland et al. | 280/737 |
| 5,778,528 | A | 7/1998 | Saka et al. | |
| 5,782,652 | A | 7/1998 | Feher et al. | |
| 6,056,584 | A | 5/2000 | Daoud | |
| 7,121,870 | B1 | 10/2006 | Chen | |
| 2007/0032137 | A1 | 2/2007 | Caveney et al. | |

FOREIGN PATENT DOCUMENTS

| | | | |
|---|---|---|---|
| EP | 0829944 | A2 | 3/1998 |
| JP | 07042648 | A * | 2/1995 |
| WO | WO 2005/030528 | | 4/2005 |

OTHER PUBLICATIONS

Moore, J., et al, "Insulation Displacement Contact Technology:Implications for Sensors and Actuators," May 1, 3pgs, http://archives.sensorsmag.com/articles/0501/63/main.shtml.

"IDC Cable, Headers & Connectors," Electus Distribution Reference Data Sheet, 2004, 4 pages.

International Search Report for S.N. PCT/1B2010/000773 dated Jul. 22, 2010 (13 pages).

* cited by examiner

*Primary Examiner* — Anh T Mai
(74) *Attorney, Agent, or Firm* — Dierker & Associates, P.C.

(57) ABSTRACT

A dual sided connector block for a solenoid is provided which may be used in multiple designs. The dual sided connector block includes a base, a first terminal insertion slot on a first side of the base, a second terminal insertion slot on the second side of the base, a tie-off post, and a magnet wire. The magnet wire is operatively configured as a solenoid coil and is routed inside of the base and wound around the tie off post. The magnet wire is accessible to a connector blade inserted through either the first terminal insertion slot or the second terminal insertion slot.

15 Claims, 4 Drawing Sheets

DUAL SIDED CONNECTOR BLOCK

BACKGROUND

The present disclosure relates generally to a dual sided connector block for a solenoid. It is generally known that the orientation of a solenoid coil may be different in different applications. The magnet wire of a solenoid coil is in electric communication with the vehicle, and the electrical attachment of the solenoid coil to the vehicle may occur through an insulation displacement connector wherein the base for the insulation displacement contact is integral to the solenoid bobbin.

Insulation displacement contacts or insulation displacement connectors are particularly useful in the manufacture and assembly of solenoid systems. Such connectors allow for quick and easy electrical communication from one component to another component. Under insulation displacement contact technology, individual wires or conductors keep their insulation while being pressed against at least one electrically conductive blade. The at least one blade cuts through the insulation to make contact with the conductor. This saves time during the assembly process because the insulation is displaced or pushed aside around the conductors or wires, thereby making direct electrical contact with the at least one electrically conductive blade.

Accordingly, the wiring used in conjunction with insulation displacement contacts is insulated, and the insulation may be displaced at the same time the electrical connection is made. It is to be understood that a blade connector is generally implemented for insertion into the insulation displacement contact block. The blade connector includes both a blade and an electrical contact wherein the blade cuts through the insulation of the wire within the insulation displacement contact block to establish the connection between the wire within the connection block and a wire connected to the blade connector.

With respect to solenoid coil wiring, wiring from the solenoid coil is routed from the coil to the insulation displacement contact block where electrical contact is established with the vehicle electrical system.

SUMMARY

A dual sided connector block for a solenoid according to embodiment(s) as disclosed herein includes a base, a first terminal insertion slot on a first side of the base, a second terminal insertion slot on the second side of the base, a tie-off post, and a magnet wire. The magnet wire is operatively configured as a solenoid coil and is routed inside of the base and wound around the tie off post. The magnet wire is accessible to a connector blade through either of the first terminal insertion slot or the second terminal insertion slot.

BRIEF DESCRIPTION OF THE DRAWINGS

Features and advantages of embodiments of the present disclosure will become apparent by reference to the following detailed description and drawings, in which like reference numerals correspond to the same or similar, though perhaps not identical, components. For the sake of brevity, reference numerals or features having a previously described function may or may not be described in connection with other drawings in which they appear.

DETAILED DESCRIPTION

Figure 1A:
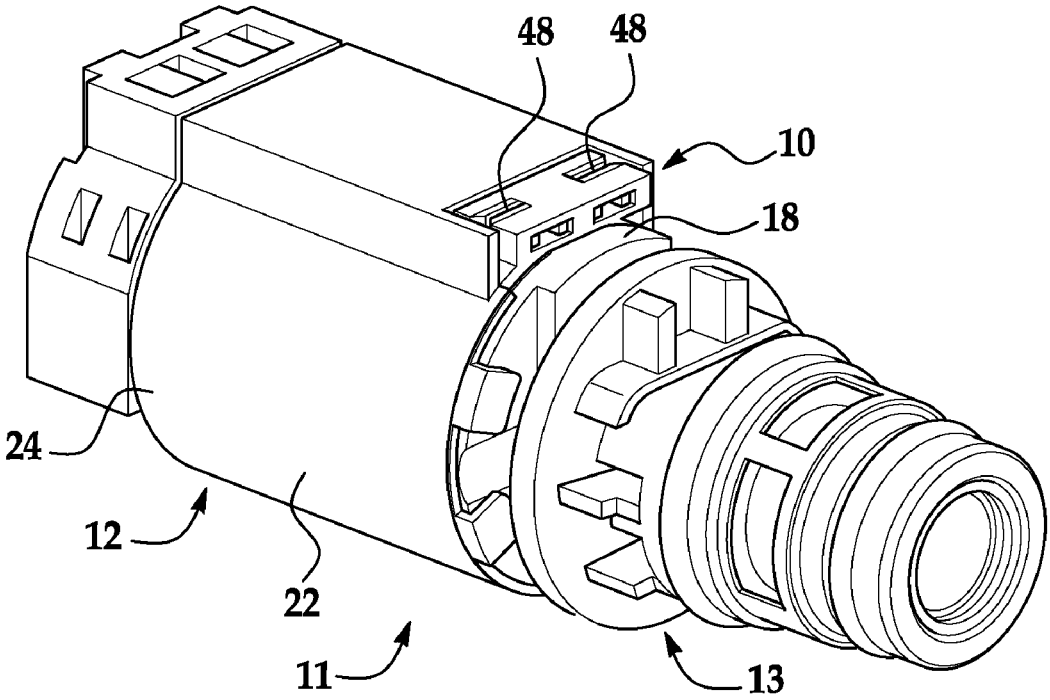
FIG. 1A is an isometric view of an embodiment of the present disclosure with the dual sided connector shown on a first end of the solenoid coil with the wiring housing and coil housing installed.

The present disclosure provides a dual orientation connector block 10 that may be integral to a solenoid bobbin 20 such that the component may be used in different system designs such as but not limited to various solenoid valves. Implementing the same connector block 10 in different designs provides economies of scale realized, for example, through reduced manufacturing complexity, tooling costs, and design time. A magnet wire 42 in a traditional insulation displacement contact (IDC) connector block 2 must be sufficiently supported within the insulation displacement contact (IDC) connector block 2. Therefore, as shown in FIG. 1B, a prior art IDC connector block 2 traditionally has a left side 4, a right side (not shown) and a backside (not shown) in addition to the front side 6 that includes at least one terminal slot 8. The left side 4, a right side (not shown) and a backside (not shown) in a traditional IDC connector 2 support the magnet wire (not shown in FIG. 1B). Therefore, there is traditionally only one side remaining in the connector block 2, the fourth or front side 6, which may define the terminal slot 8 for receiving a connector blade 50 (shown in FIGS. 2-4). Accordingly, the terminal slot 8 is provided on only one side, therefore providing access from only one direction. This limitation restricts the configuration of a design given that such a traditional IDC connector 2 receives electrical connections (e.g., connector blade 50 in FIG. 2) from only one direction relative to the IDC connector 2.

The present inventors identified this limiting design restriction in the prior art and fortuitously discovered that wire tension may be used to load the magnet wire 42 from the top/third side 32 so that the magnet wire 42 only needs to be supported on the bottom and top/third side 32 (shown in FIGS. 2-7) of the connector block 10 through the wire routing and containment slots and the tie posts 38. As a non-limiting example, the magnet wire 42 may be supported by the tie off posts 38 by winding the magnet wire 42 around the tie off posts 38 as shown in FIGS. 2-4 and 6-7. As a result of implementing wire tension to support the magnet wire 42 instead of the sides of the prior connector block 2 (shown in FIG. 1B), a terminal slot 34, 36 (shown in FIGS. 2-7) may be defined in at least two sides 28, 30 of the connector block 10 of the present disclosure.

Figure 1B:
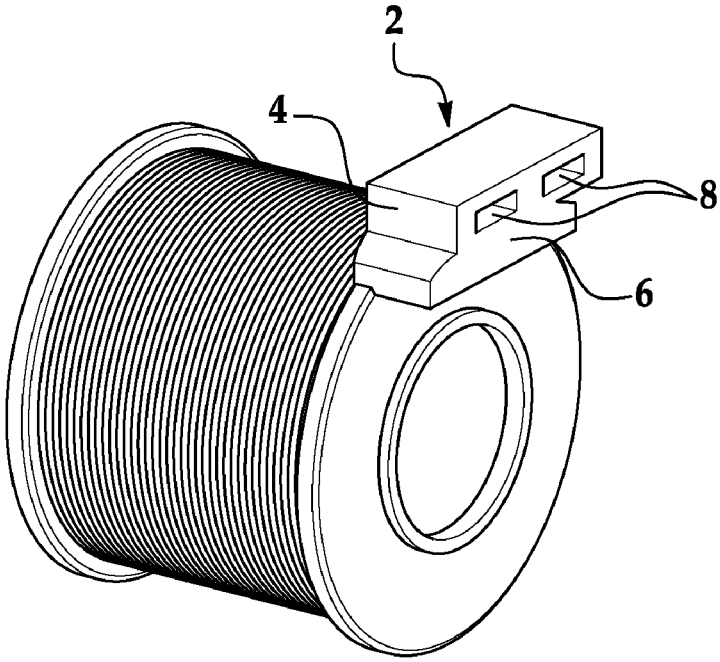
FIG. 1B PRIOR ART
FIG. 1B is an isometric view of a prior art insulation displacement contact block having three support walls and a terminal slot on only one side of the block.
Figure 2:
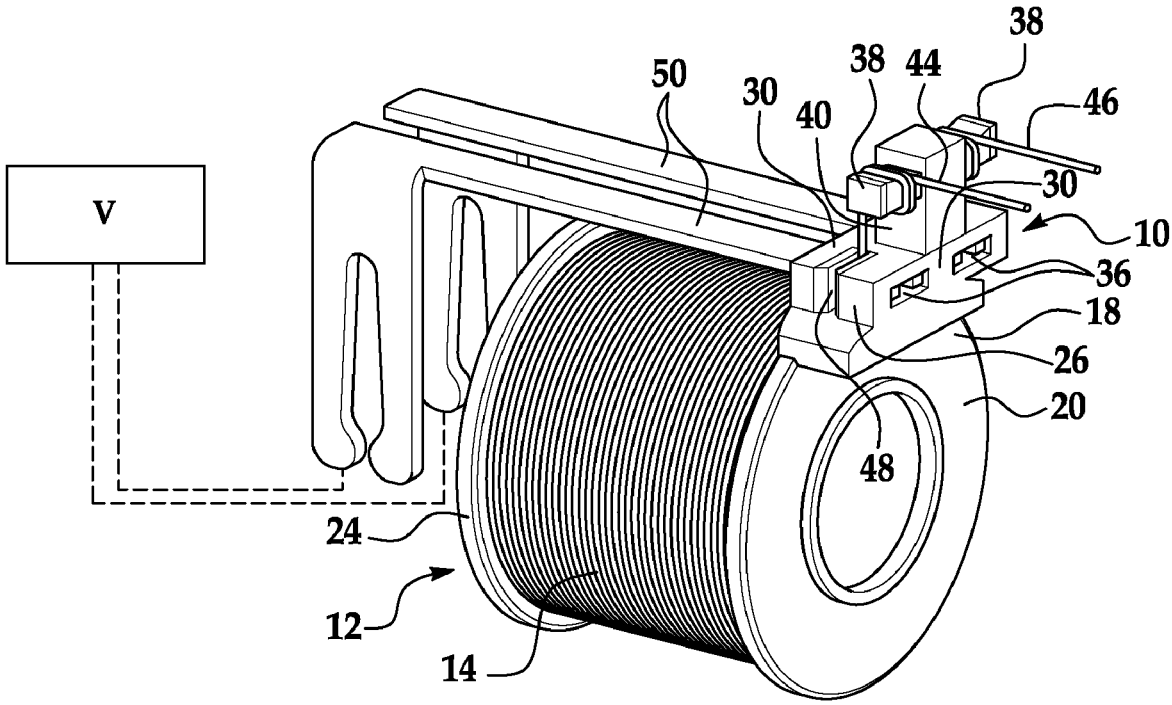
FIG. 2 is a first isometric view of the embodiment of FIG. 1A with the wiring housing and coil housing removed.

Referring now to FIG. 1A, a dual sided insulated displacement contact block 10, hereinafter referred to as a "dual sided connector block" 10 or "connector block" 10, is shown on a solenoid 12 in an isometric view. As shown in FIG. 2, the dual sided connector block 10 may be disposed on a first end 18 of solenoid coil 14 and may be integral to the bobbin 20. It is to be understood that, at times, it is desirable to house the connector block 10 so that the wiring or connector blades (50 in FIG. 2) is/are routed over the housing 22 of the solenoid coil 14 and connects to the vehicle system (not shown) at the second end 24 of the solenoid coil 14. With reference to FIGS. 1A and 2 together, the orientation of the solenoid system 11 is such that the dual sided connector block 10 is adjacent valve body 13 at the first end 18 of the solenoid coil 14. In another embodiment, the connector block 10 is housed on the first end 18 of the solenoid coil 14 such that the wiring or connector blades 50 for the solenoid coil 14 to the vehicle V is/are also adjacent to the first end 18 of the solenoid coil 14 (as shown in FIG. 5).

Figure 5:
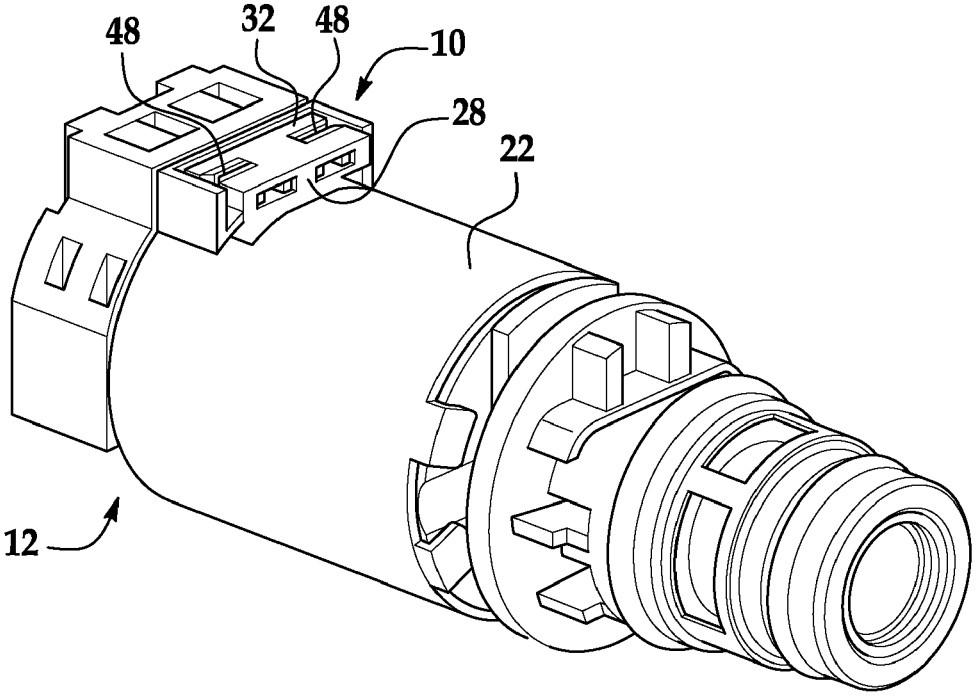
FIG. 5 is an isometric view of another embodiment of the present disclosure with the dual sided connector shown on the second end of the solenoid coil with the wiring housing and coil housing installed.

Traditionally, separate designs for the solenoid bobbin 20 and connector block 10 would be required to execute the two different orientations shown in FIGS. 1 and 5, given that insulation displacement connector (IDC) connector blocks 10 operate in one direction where the IDC terminal slots 34, 36 are generally disposed on a single side of the connector block 10. In order to reduce the cost associated with having separate designs for the different orientations for the wiring or connector blade arrangement, the present inventors have provided a solution where a dual sided connector block 10 may be implemented in conjunction with a bobbin 20 for a solenoid coil 14 so that the same design and component may be used in different design arrangements. Thus, this dual sided connector block 10 reduces cost and facilitates the manufacturing and distribution process by providing a single product that could be used in multiple design arrangements.

As indicated, FIG. 1A illustrates the dual sided connector block 10 on a first end 18 of a solenoid 12 so that the wiring system is routed over the housing 22 of the solenoid coil 14 and connects to the vehicle system (not shown in FIG. 1A) at the second end 24 of the solenoid coil 14. This is one of two different orientations or arrangements for the connector block 10 component. It is to be understood that the connector block 10 is integral to the bobbin 20 for the solenoid coil 14, and the present disclosure provides a user with the flexibility to use this connector block 10 and its associated solenoid bobbin 20 in different designs. The dual sided connector block 10 includes a base 26 having a first side 28 (shown in FIGS. 3 and 4), a second side 30 (shown in FIG. 2) opposite the first side 28, and an intermediate wall 32 (shown in FIGS. 3 and 4) extending therebetween. As indicated, the base 26 of the dual sided connector block 10 is integral to the bobbin 20 for a solenoid coil 14.

Further included on the dual sided connector block 10 is a first terminal insertion slot 34 which is defined on the first side 28 of the base 26. A second terminal insertion slot 36 is defined on the second side 30 of the base 26. Moreover, at least one tie off post 38 may be removeably disposed on the top/third side 32 of the base 26. It is to be understood that the tie off post 38 may be designed to be disposed on the base 26 through a weakened connecting joint 40 such as, e.g., a living hinge, snap fit, or small bridging connection 40 (shown in FIGS. 2-4 and 6-7) between the tie off post 38 and the base 26 so that the tie off post 38 may be removed from the base 26 manually and with ease after the connection has been made with the dual sided connector through any one or more of the first and second terminal insertion slots 34, 36, respectively.

The dual sided connector block 10 further includes a magnet wire 42 that is operatively configured as a solenoid coil 14 on the bobbin 20 wherein the magnet wire 42 is wound about the bobbin 20. The magnet wire 42 includes two ends 44, 46 that are not wound on the bobbin 20 for the solenoid 12 and are routed through at least one wire routing and containment slot 48 to the tie off post 38. It is to be understood that the wire routing and containment slot(s) 48 may be defined in the base 26 of the dual sided connector block 10 (as shown in FIGS. 1-4).

Figure 3:
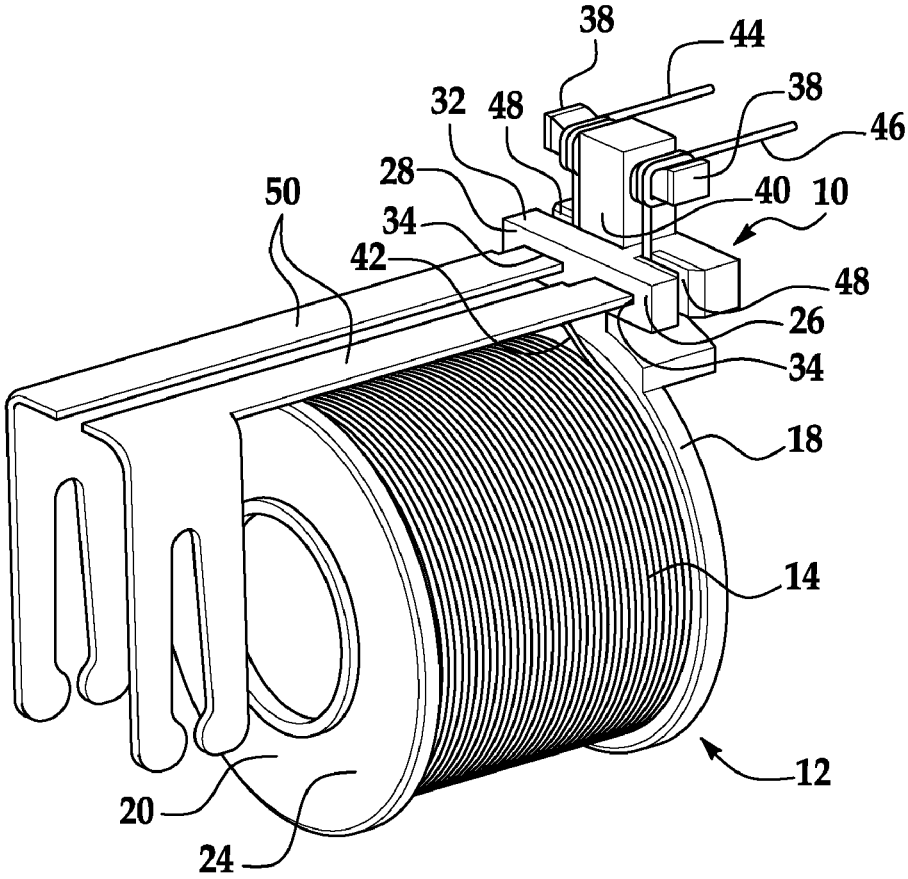
FIG. 3 is a second isometric view of the embodiment of FIG. 1A with the wire housing and coil housing removed.
Figure 4:
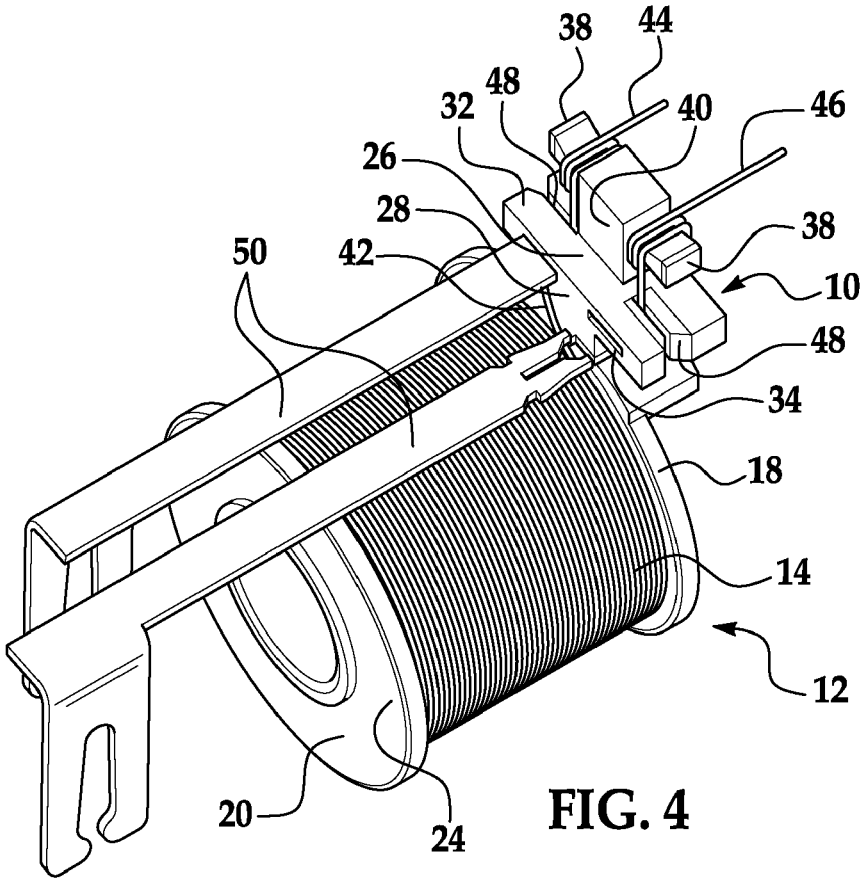
FIG. 4 is a top view of the embodiment of FIG. 3 with the wire housing and coil housing removed.

Furthermore, the wire routing and containment slots 48 may be defined in the base 26 as apertures or recesses within the base 26, rather than the slots 48 shown in FIGS. 1-4. Wire routing and containment slots 48 may generally be used within the base 26 to better facilitate a user to route each end of the magnet wire 42 within the base 26 and wind the magnet wire 42 around the tie off post 38. Accordingly, the magnet wire 42 is suspended within the base 26 and is exposed to a connector blade 50 through either the first terminal insertion slot 34 or the second terminal insertion slot 36, as shown in FIGS. 2-4.

Where insulated displacement connector blocks 10 are used, the magnet wire 42 is generally an insulated wire 42 wherein the insulation around the wire 42 must be cut or otherwise displaced in order to make the electrical connection. Accordingly, during the assembly process, the tie off post 38 serves to suspend the magnet wire 42 in its appropriate location within the interior of the connector block 10 and accessible from either the first terminal insertion slot 34 or the second terminal insertion slot 36. Once the connector blade 50 has been inserted through either the first terminal insertion slot 34 or the second terminal insertion slot 36, the connector blade 50 cuts through the insulation of the magnet wire 42 and provides the electrical connection between the magnet wire 42 and the vehicle V. Accordingly, the portion of the magnet wire 42 between the connector blade 50 and the tie off post 38 may be severed, thereby allowing an excess portion of magnet wire 42 to be removed with the tie off post 38 as the tie off post 38 is detached from the connector block 10.

Figure 6:
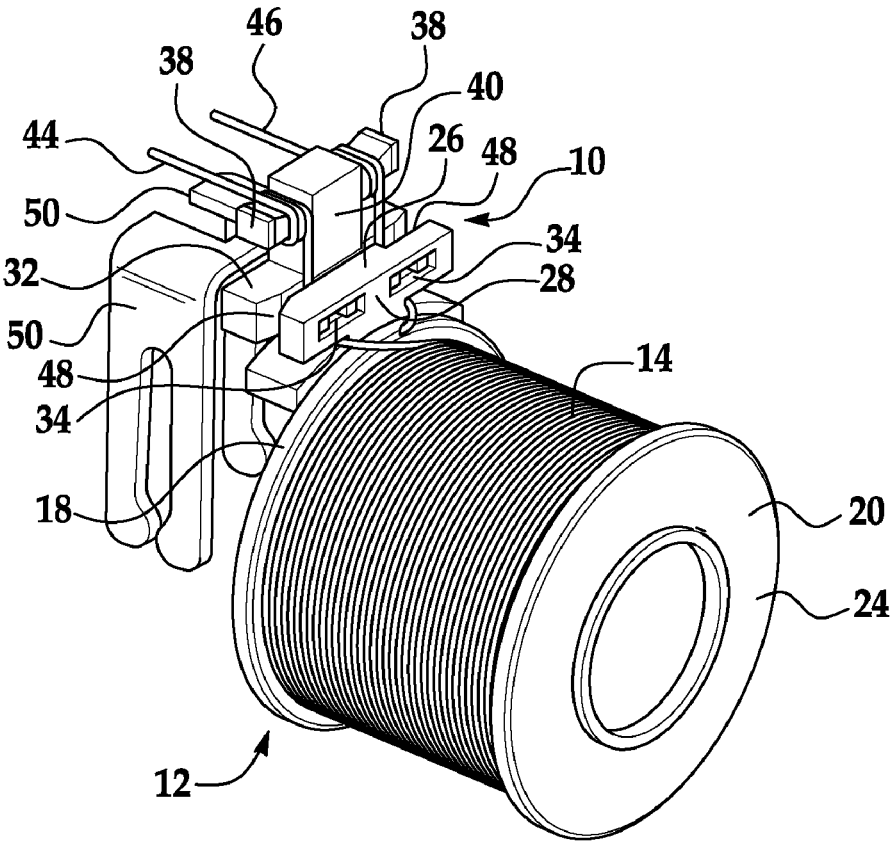
FIG. 6 is an isometric view of the embodiment of FIG. 5 with the dual sided connector shown on the second end of the solenoid coil with the wiring housing and coil housing removed.
Figure 7:
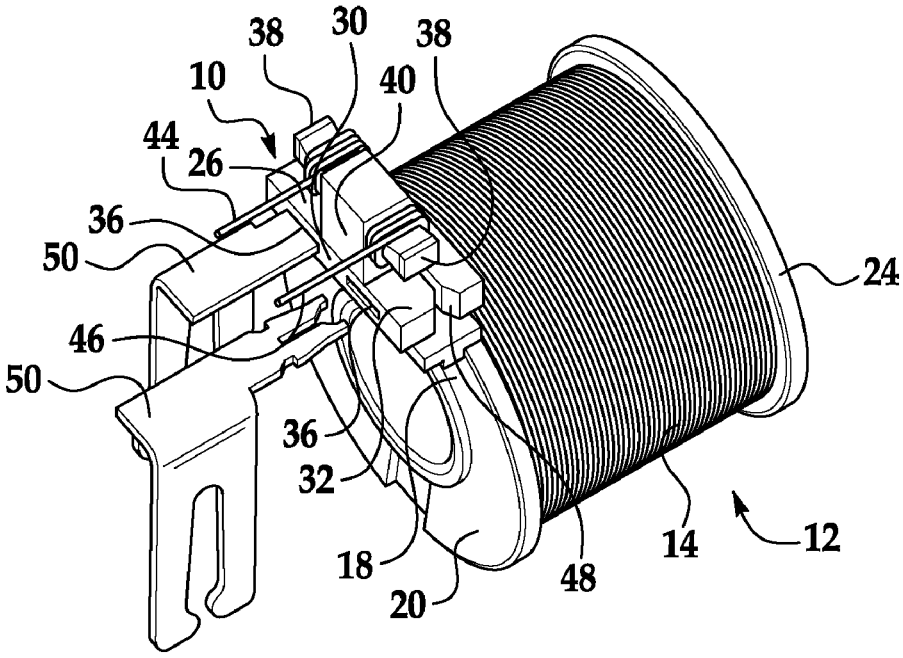
FIG. 7 is a top view of the embodiment of FIG. 5 with the wire housing coil housing removed.

It is to be understood that the connector block 10 may be made of polyamide (nylon) such as, but not limited to, Zytel HTN35HSL 35% glass filled polyamide resin (commercially available from E.I. duPont de Nemours and Co.), or of any other suitable polymeric material having similar chemical and mechanical properties to nylon. As indicated, the base 26 of the dual sided connector block 10 may be integral to the bobbin 20 of the solenoid coil 14. The bobbin 20 for the solenoid coil 14 includes a first end 18 and a second end 24, and the dual sided connector of the present disclosure is disposed on a first end 18 of the bobbin 20 for the solenoid coil 14. Since the dual sided connector block 10 has terminal insertion slots on both of the first and second sides, the blade connector 50 may be routed either adjacent to the first end 18 of the bobbin 20 (as shown in FIGS. 5-7), or over the housing 22 of the solenoid coil 14 (as shown in FIGS. 1A, 2-4).

As indicated, the completed connector block 10 of the present disclosure generally does not include the tie off posts 38 once the electrical connection has been made between a connector blade 50 and the connector block 10. Therefore, in reference to FIGS. 1A and 2-7 together, upon completed manufacture of the connector block 10 of the present disclosure, the dual sided connector block 10 may include a base 26, a first terminal insertion slot 34 on the first side 28 of the base 26, a second terminal insertion slot 36 on the second side 30 of the base 26, and a magnet wire 42 that is in electrical communication with a vehicle V through a connector blade 50. The magnet wire 42 terminates at the connector blade 50 where the connector blade 50 intersects and cuts (not shown) into the magnet wire 42. Accordingly, the magnet wire 42 is accessed by the connector blade 50 through one of the first terminal insertion slot 34 or the second terminal insertion slot 36.

The magnet wire 42 may be operatively configured as the solenoid coil 14. The terminal ends 44, 46 of the magnet wire 42, however, are disposed within the base 26 and as indicated, are in communication with the vehicle V through its electrical connection with the connector blade 50. Moreover, the wire routing and containment slot 48 maintains the magnet wire 42 within the slot 48 even after the connector blade 50 has joined with the magnet wire 42 which is insulated except where the connector blade 50 has cut through the insulation in order to create the electrical connection between the vehicle V and the magnet wire 42.

While multiple embodiments have been described in detail, it will be apparent to those skilled in the art that the disclosed embodiments may be modified. Therefore, the foregoing description is to be considered exemplary rather than limiting.

What is claimed is:

1. A dual sided connector block for a solenoid, the dual sided connector block comprising:

a base having a back side, a front side facing opposite the back side and an intermediate wall extending therebetween, the base being integral with a bobbin for a solenoid coil;

a first terminal insertion slot on the back side of the base;

a second terminal insertion slot on the front side of the base;

a tie off post removeably disposed on the intermediate wall of the base; and a magnet wire operatively configured as the solenoid coil on the bobbin, the magnet wire having a predetermined end selected from a first end and a second end, the predetermined end of the magnet wire routed inside of the base and supported by the tie off post, the predetermined end of the magnet wire being accessible to a connector blade insertable through each of the first terminal insertion slot or the second terminal insertion slot.

2. The dual sided connector block as defined in claim 1 wherein the tie off post is operatively configured to be detachable from the base after the connector blade has cut into the magnet wire.

3. The dual sided connector block as defined in claim 1 wherein the connector blade is configured to provide electrical communication from a vehicle to the magnet wire.

4. The dual sided connector block as defined in claim 1 wherein the connector block is formed from a polyamide material.

5. The dual sided connector block as defined in claim 1 wherein the connector block is disposed on an end of the bobbin.

6. The dual sided connector block as defined in claim 1 wherein the base defines a wire routing slot, the wire routing slot being operatively configured to guide the magnet wire through the base to the tie off post.

7. The dual sided connector block as defined in claim 1, further comprising insulation surrounding the magnet wire substantially along an entire length of the magnet wire.

8. A dual sided connector block for a solenoid, comprising:

a base having a back side and a front side facing opposite the back side, the base being integral with a bobbin for a solenoid coil;

a first terminal insertion slot on the back side of the base;

a second terminal insertion slot on the front side of the base, the first and the second terminal insertion slot each operatively configured to receive a connector blade; and a magnet wire operatively configured as the solenoid coil and having a predetermined end selected from a first end and a second end, the predetermined end disposed within the base, the predetermined end of the magnet wire being accessible from each of the first terminal insertion slot or the second terminal insertion slot.

9. The dual sided connector block as defined in claim 8 wherein the base defines a wire routing and containment slot, the wire routing and containment slot being operatively configured to guide the magnet wire from the bobbin to a tie off post.

10. The dual sided connector block as defined in claim 8, further comprising insulation surrounding the magnet wire substantially along an entire length of the magnet wire.

11. The dual sided connector block as defined in claim 8, further comprising a tie off post operatively configured to be detachable from the base after the connector blade has cut into the magnet wire.

12. The dual sided connector block as defined in claim 8 wherein the connector blade is configured to provide electrical communication from a vehicle to the magnet wire of the solenoid.

13. The dual sided connector block as defined in claim 8 wherein the connector block is formed from a polyamide material.

14. The dual sided connector block as defined in claim 8 wherein the connector block is disposed on an end of the bobbin.

15. The dual sided connector block as defined in claim 8 wherein the base defines a wire routing slot, the wire routing slot being operatively configured to guide the magnet wire through the base to a tie off post.

* * * * *